United States Patent [19]

Jacobs

[11] 4,111,281

[45] Sep. 5, 1978

[54] BUILDING FRONT ROPE LIFT

[76] Inventor: Max Jacobs, #179, Wittkullerstrasse, Solingen-Wald, Fed. Rep. of Germany

[21] Appl. No.: 810,454

[22] Filed: Jun. 27, 1977

[30] Foreign Application Priority Data

Jun. 23, 1976 [DE] Fed. Rep. of Germany ..... 2628041

[51] Int. Cl.[2] ..... B61B 7/04

[52] U.S. Cl. ..... 182/10; 182/142; 187/6; 187/12

[58] Field of Search ..... 187/2, 6, 7, 8, 10, 187/11, 12, 27; 182/10, 11, 142, 144

[56] References Cited

U.S. PATENT DOCUMENTS 293,322 2/1884 Griswold ..... 182/10

349,870 9/1886 Woodward ..... 187/12

481,888 8/1892 Bergeron et al. ..... 187/6

*Primary Examiner*—Evon C. Blunk

*Assistant Examiner*—Jeffrey V. Nase

*Attorney, Agent, or Firm*—John C. Smith, Jr.

[57] ABSTRACT

A building front rope lift for rescuing persons in particular subject to fire hazards in tall buildings comprises a lift cage to which a first roller is secured and which is suspended from one end of at least one load rope led around at least one guide roller secured to a tall building. The other end of the load rope extends from said guide roller downwardly inclined to a winch drum to which it is connected. A traction rope carries at one end a second roller which is arranged to roll on the load rope and is diverted by the first roller into the direction of the downwardly inclined load rope and connected by its other end to a further winch drum.

5 Claims, 1 Drawing Figure

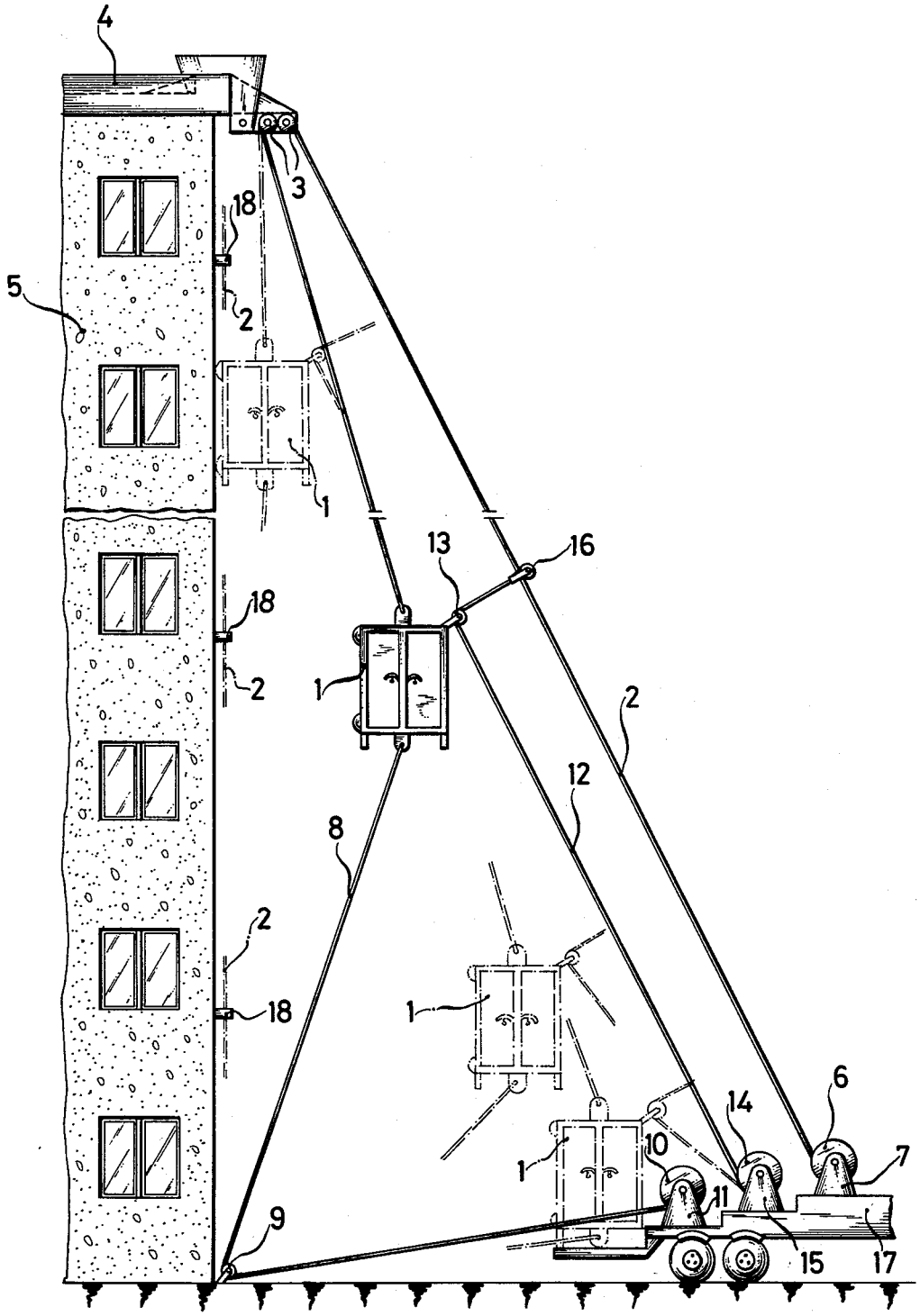
4
3
18
5
2
1
13
16
18
2
1
2
12
8
2
18
1
6
14
10
7
1
11
9
15
17

BUILDING FRONT ROPE LIFT

BACKGROUND OF THE INVENTION

This invention relates to a building front rope lift for rescuing persons in particular subject to fire hazards in tall buildings.

A building front lift provided for rescuing persons subject to fire hazards and having two load chains and a traction chain is known the lift cage of which carries rollers at the head end rolling on the ends of the load chains extending downwardly inclined and the traction chain of which likewise extending downwardly inclined is fixedly arranged externally at the lift cage with its one end and is connected to the drum of a winch remote from the building together with the load chains. The load chains are unwound from the drum of the winch after the lift cage has been occupied by the persons to be rescued, while the traction chain oppositely wound is wound up, the lift cage being lowered to the ground. As a result of the fact that the lift cage is lowered in a certain distance from the building, the persons in the lift cage are substantially protected against flames bursting out of those windows of the stories already having caught fire or against fumes passing off. This conventional building front lift is subject to a material disadvantage, however, which is that its lift cage is able to cover only two stations, namely ground and one story of the building, preferably the uppermost story or in case of a suitable arrangement of the guide rollers for the load chains the roof of the building. If now for instance the end station at the building is located at the uppermost story, there is no possibility of rescue by means of the lift for persons for instance cut off in the intermediate stories by flames and fumes.

SUMMARY OF THE INVENTION

It is therefore the object of the present invention to develop the building front rope lift of the species recited initially in such a way that its lift cage is able to be moved to practically any story of the building along its way in order to receive persons.

To attain this object the present invention provides a building front rope lift for rescuing persons in particular subject to fire hazards in tall buildings, comprising (a) a lift cage suspended from one end of at least one load rope led around at least one guide roller secured to a tall building, said load rope extending from said guide roller downwardly inclined to a winch drum to which its other end is connected;

(b) a first roller secured to the lift cage, and (c) a traction rope led around the first roller and carrying at one end a second roller arranged to roll on the load rope, said traction rope being diverted by the first roller into the direction of the downwardly inclined load rope and connected by its other end to a further winch drum.

By increasing the tension in the traction rope, the lift cage of the building front rope lift is drawn away from the front of the building in the direction towards the downwardly inclined load rope, while by relieving tension in the traction rope the lift cage pivots into a gravity position in which it is positioned so close to the front of the building that the persons to be rescued may enter the lift cage. The lift cage is constantly in a vertical position, in particular in case a positioning traction rope is secured with its one end to the bottom part of the lift cage and is connected with its other downwardly guided end after a diversion at a deviating roller fixedly arranged on ground to the drum of further winch.

BRIEF DESCRIPTION OF THE DRAWING

An embodiment of the invention will now be described by way of example and with reference to the accompanying diagrammatic drawing in which the only FIGURE is a side elevational view of a building front rope lift according to the invention.

DESCRIPTION OF THE PREFERRED EMBODIMENT

The drawing shows a building front rope lift which comprises a lift cage 1 suspended from one end of one or more load ropes 2. Each load rope 2 is led around one or preferably two juxtaposed guide rollers 3 which are secured to a tall building 5 and is connected with its end extending downwardly inclined to the drum 6 of a winch 7. It has proved advantageous to arrange the guide rollers at the level of the roof of the building. At the bottom part of the lift cage 1, a positioning traction rope 8 is attached with its one end, and it is connected with its other downwardly extending end after a diversion at a deviating roller 9 fixedly arranged on ground to the drum 10 of a winch 11. The reference numeral 12 denotes a traction rope. This traction rope 12 is diverted with its one end at a first roller 13 laterally arranged at the lift cage 1 in the direction towards the downwardly guided end of the load rope 2 and is guided on this end by means of a second roller 16. The traction rope 12 is connected with its other downwardly guided end to the drum 14 of a winch 15. The winches 7, 11 and 15, which are desirably driven mechanically, are mounted on an undercarriage 17 which is positioned remote from the front of the tall building 5. The lift cage 1 may also be placed on the undercarriage 17 after being released from the load rope 2 and the positioning traction rope 8, like this has been shown by dot and dash lines in the drawing. At the front of the tall building 5 clips 18 are furthermore fixedly arranged in which the downwardly hanging ends of the load rope 2 after releasing thereof from the lift cage 1 are retainable.

For lifting the lift cage 1 to the desired height, for instance to the level of the penultimate story of the tall building 5, by an operation of the winches 7, 11 and 15 the load rope 2 is wound up on the drum 6 of the winch 7, and the ropes 8 and 12 are unwound from the drums 10 and 14 of the winches 11 and 15, but in doing so, the positioning tracting rope 8 is maintained under such a tension that the lift cage 1 maintains its vertical position even in the event of windy weather. The lift cage 1 is pulled up close to the front of the tall building 5. When the lift cage 1 is to be pulled up remote from the front of the tall building 5, the load rope 2 is likewise wound up on the drum 6 of the winch 7, and the positioning traction rope 8 is unwound from the drum 10 of the winch 11, whereas the traction rope 12 is unwound decelerated from the drum 14 of the winch 15. The distance by which the lift cage 1 is heaved up remote from the front of the tall building 5 results from the rate of deceleration of the traction rope 12. When the lift cage 1 has reached the desired height, the traction rope 12 is unwound from the drum 14 of the winch 15 so far and the positioning traction rope 8 is wound up on the drum 10 of the winch 11 likewise so far that the lift cage 1 is translated so close to the building front that the persons to be rescued are able to enter the lift cage 1. After the persons to be rescued have occupied the lift cage 1, the positioning traction rope 8 is unwound from the drum 10 of the winch 11, the traction rope 12 is wound up on the drum 14 of the winch 15, and the load rope 2 is unwound decelerated from the drum 6 of the winch 7 until the lift cage 1 has reached ground in the desired distance from the building. In doing so, the positioning traction rope 8 is maintained under tension while the lift cage 1 is lowered so that the lift cage 1 is stabilized in all positions.

It is of course within the scope of the invention that instead of one load rope 2, one positioning traction rope 8 and one traction rope 12 two thereof are provided in order to reduce the instability of the lift cage 1 as far as possible. The embodiment described and shown is therefore to be considered in all respects as illustrative and not restrictive.

What is claimed is:

1. A building front rope lift for rescuing persons in particular subject to fire hazards in tall buildings, comprising (a) a lift cage suspended from one end of at least one load rope led around at least one guide roller secured to a tall building, said load rope extending from said guide roller downwardly inclined to a winch drum to which its other end is connected;

(b) a first roller secured to the lift cage, and (c) a traction rope led around the first roller and carrying at one end a second roller arranged to roll on the load rope, said traction rope being diverted by the first roller into the direction of the downwardly inclined load rope and connected by its other end to a further winch drum.

2. A building front rope lift as claimed in claim 1, wherein the guide roller is arranged at the level of the roof of the building.

3. A building front rope lift as claimed in claim 1, wherein a positioning traction rope is provided to connect the bottom part of the lift cage to a third winch drum.

4. A building front rope lift as claimed in claim 3, wherein a roller for deviating the positioning traction rope between the lift cage and the third winch drum is provided.

5. A building front rope lift as claimed in claim 3, wherein the winch drums are arranged at a distance from the building.

* * * * *